US012607078B1

(12) United States Patent
Pross et al.

(10) Patent No.: US 12,607,078 B1
(45) Date of Patent: Apr. 21, 2026

(54) HYDRAULIC SPIDER SYSTEM AND METHODS FOR USE THEREOF

(71) Applicant: FORUM US, INC., Houston, TX (US)

(72) Inventors: Arne Pross, Hamburg (DE); Rumen Mittelstädt, Hamburg (DE)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 19/060,533

(22) Filed: Feb. 21, 2025

(51) Int. Cl.
*E21B 19/10* (2006.01)

(52) U.S. Cl.
CPC ..... *E21B 19/10* (2013.01)

(58) Field of Classification Search
None
See application file for complete search history.

(56) References Cited

U.S. PATENT DOCUMENTS

| | | | | |
|---|---|---|---|---|
| 1,788,542 | A * | 1/1931 | Page | E21B 19/10 188/67 |
| 6,212,976 | B1 | 4/2001 | Stogner | |
| 7,013,759 | B1 | 3/2006 | Childress, II | |
| 7,032,690 | B2 | 4/2006 | Ramey et al. | |
| 7,117,938 | B2 | 10/2006 | Hamilton et al. | |
| 7,216,717 | B2 | 5/2007 | Severin et al. | |
| 7,296,630 | B2 | 11/2007 | Severin et al. | |
| 7,398,833 | B2 | 7/2008 | Ramey et al. | |
| 7,510,033 | B2 | 3/2009 | Lutzhoft et al. | |
| 7,699,098 | B2 | 4/2010 | Hamilton | |
| 8,079,627 | B2 | 12/2011 | Lutzhoft et al. | |
| 8,596,344 | B2 | 12/2013 | Lutzhoft et al. | |
| 9,057,225 | B2 | 6/2015 | Vierke et al. | |
| 9,062,698 | B2 | 6/2015 | Baier et al. | |
| 9,181,762 | B2 | 11/2015 | Stoldt et al. | |
| 9,976,365 | B2 | 5/2018 | Vierke et al. | |
| 10,316,597 | B2 | 6/2019 | Rios | |
| 10,329,854 | B2 | 6/2019 | Rios et al. | |
| 10,544,636 | B1 | 1/2020 | Vierke et al. | |
| 10,570,679 | B2 | 2/2020 | Stoldt et al. | |
| 10,648,254 | B2 | 5/2020 | Meuth | |
| 10,753,162 | B2 | 8/2020 | Vo | |
| 10,767,425 | B2 | 9/2020 | Meuth et al. | |
| 10,808,468 | B2 | 10/2020 | Vo | |
| 10,808,469 | B2 | 10/2020 | Vo | |
| 10,808,470 | B2 | 10/2020 | Vo | |
| 11,156,038 | B1 | 10/2021 | Granger et al. | |

(Continued)

FOREIGN PATENT DOCUMENTS

| | | | |
|---|---|---|---|
| CA | 2122623 | C | 8/2001 |
| CA | 2224638 | C | 2/2004 |
| CA | 2943038 | C | 11/2021 |

OTHER PUBLICATIONS

FMS-350-275-C Flush Mounted Spider, Technical Manual No. TM-FMS-350-01, McCoy Global, 156 pages.

*Primary Examiner* — Blake Michener
(74) *Attorney, Agent, or Firm* — Patterson + Sheridan, LLP

(57) ABSTRACT

An insert for a slip in a hydraulic spider, including an engagement body. The engagement body including an engagement surface. The engagement surface including a first concave surface portion and a second concave surface portion. The first concave surface portion including teeth with a first radius of curvature. The second concave surface portion including teeth with a second radius of curvature that is different than the first radius of curvature.

16 Claims, 7 Drawing Sheets

(56) References Cited

U.S. PATENT DOCUMENTS

| | | | | |
|---|---|---|---|---|
| 2004/0011600 | A1 | 1/2004 | Ramey et al. | |
| 2004/0194967 | A1* | 10/2004 | Jaensch | B25B 13/5016 166/380 |
| 2014/0265395 | A1* | 9/2014 | Elsayed | E21B 19/10 294/102.1 |
| 2017/0096865 | A1* | 4/2017 | Wiedemann | E21B 33/0422 |
| 2019/0136647 | A1 | 5/2019 | Vierke | |
| 2024/0269787 | A1 | 8/2024 | Granger et al. | |
| 2024/0410238 | A1 | 12/2024 | Granger et al. | |

* cited by examiner

HYDRAULIC SPIDER SYSTEM AND METHODS FOR USE THEREOF

BACKGROUND

Field

Embodiments disclosed herein generally relate to a hydraulic spider for use in the oil and gas industry. In particular, embodiments disclosed herein relate to a hydraulic spider for engaging tubulars in drilling, workover, and other operations requiring tubular handling.

Description of the Related Art

A hydraulic spider is commonly used in the oil and gas industry to hold tubulars when making-up or breaking-out a threaded connection. The hydraulic spider sits in a drilling table. A tubular string, including multiple tubulars connected together, is lowered into the spider from above by an elevator. The hydraulic spider then holds a tubular of the tubular string. The elevator releases the tubular string, is moved to engage another tubular, and lowers the other tubular to a position above the tubular string. A wrench tool engages and rotates the tubular held by the elevator relative to the tubular string. The wrench tool can rotate the tubular to thread the tubulars together during a make-up operation or can rotate the tubular to unthread the tubulars from one another during a break-out operation.

Hydraulic spiders hold the tubulars using slips. When a different sized tubular is to be made-up or broken-out, the slips must be disassembled from the hydraulic spider and swapped out. Similarly, the slips must be disassembled from the hydraulic spider to allow larger tubulars and/or tubular components (e.g., tubular centralizers) to pass through the hydraulic spider.

Accordingly, there is a continuous need for new and/or improved hydraulic spider systems that can be used in different operations while minimizing disassembly and part swapping.

SUMMARY

According to one or more embodiments, an insert for a slip in a hydraulic spider, including an engagement body. The engagement body including an engagement surface. The engagement surface including a first concave surface portion and a second concave surface portion. The first concave surface portion including teeth with a first radius of curvature. The second concave surface portion including teeth with a second radius of curvature that is different than the first radius of curvature.

According to one or more embodiments, a slip for use in a hydraulic spider, including a slip body and one or more inserts coupled to an inner surface of the slip body. Each of the one or more inserts includes an engagement body. The engagement body including an engagement surface. The engagement surface including a first concave surface portion, a second concave surface portion, and a third concave surface portion. The first concave surface portion includes teeth with a first radius of curvature. The second concave surface portion includes teeth with a second radius of curvature. The third concave surface portion includes teeth with a third radius of curvature. The second concave surface portion is disposed between the first concave surface portion and the third concave surface portion. The second radius of curvature is different than the first radius of curvature and the third radius of curvature.

According to one or more embodiments, a hydraulic spider, including a hydraulic spider body, one or more slips, and one or more actuators. The hydraulic spider body includes a bore and one or more actuation surfaces, the one or more actuation surfaces includes a taper angle of at least about 11 degrees. The one or more slips are engaged with the one or more actuation surfaces such that movement along the one or more actuation surfaces causes the one or more slips to move radially inward towards a center of the bore or radially outward away from the center of the bore. The one or more actuators are coupled to the one or more slips. The one or more actuators move the one or more slips along the one or more actuation surfaces. The one or more slips include one or more inserts defining an inner surface of the each slip. The one or more inserts include an engagement body. The engagement body includes an engagement surface. The engagement surface includes a first concave surface portion, a second concave surface portion, and a third concave surface portion. The first concave surface portion includes teeth with a first radius of curvature. The second concave surface portion includes teeth with a second radius of curvature. The third concave surface portion includes teeth with a third radius of curvature. The second concave surface portion is disposed between the first concave surface portion and the third concave surface portion.

BRIEF DESCRIPTION OF THE DRAWINGS

So that the manner in which the above-recited features of the disclosure can be understood in detail, a more particular description of the disclosure, briefly summaries above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The disclosure contemplates that terms such as "couples," "coupling," "couple," and "coupled" may include but are not limited to welding, interference fitting, magnetic coupling, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Aspects of the present disclosure provide systems, apparatus, and methods related to a hydraulic spider. The hydraulic spider includes a spider body, actuators, and slips. The slips are configured to extend toward the central axis of the bore of the hydraulic spider and retract away from the central axis of the bore by sliding along angled actuating surfaces. The slips include slip inserts. The slip inserts include an engagement surface with a first concave surface portion including a first radius of curvature and a second concave surface portion including a second radius of curvature. The first and second concave surface portions are configured to engage with tubulars corresponding to the respective radii of curvature.

Figure 1:
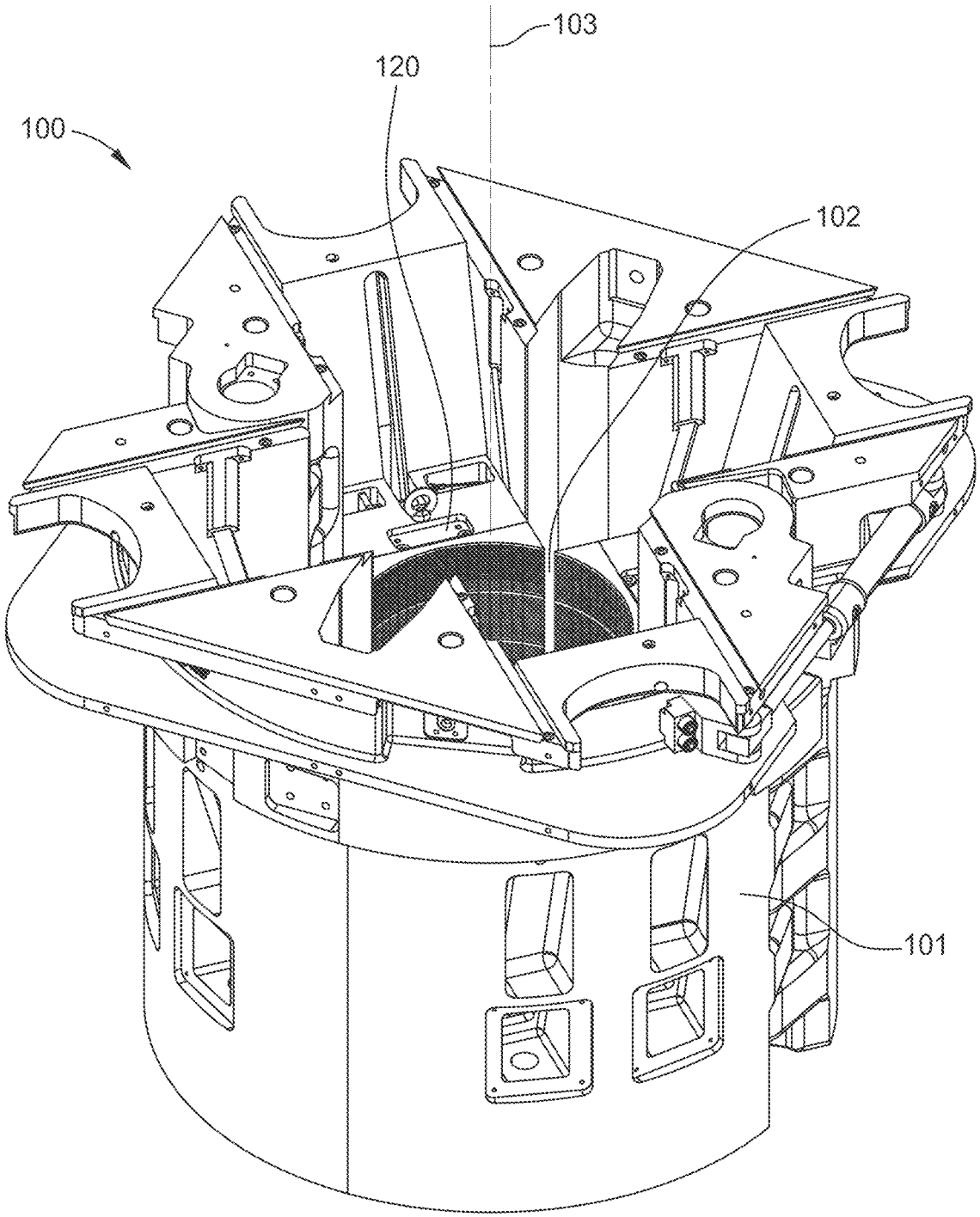
FIG. 1 illustrates an isometric view of a hydraulic spider, according to one or more embodiments.

FIG. 1 illustrates an isometric view of a hydraulic spider 100. The hydraulic spider 100 includes a spider body 101 and slips 120 disposed in the spider body 101. Some components, such as a top cover, that are located on top of the hydraulic spider 100 have been removed for clarity.

The body 101 is generally cylindrical with a bore 102 through a central axis 103 of the hydraulic spider 100. In one or more embodiments, the spider body 101 is made up of two or more body portions that may be coupled to one another. For example, the two body portions may be pivotally coupled to one another to open and close.

Figure 2A:
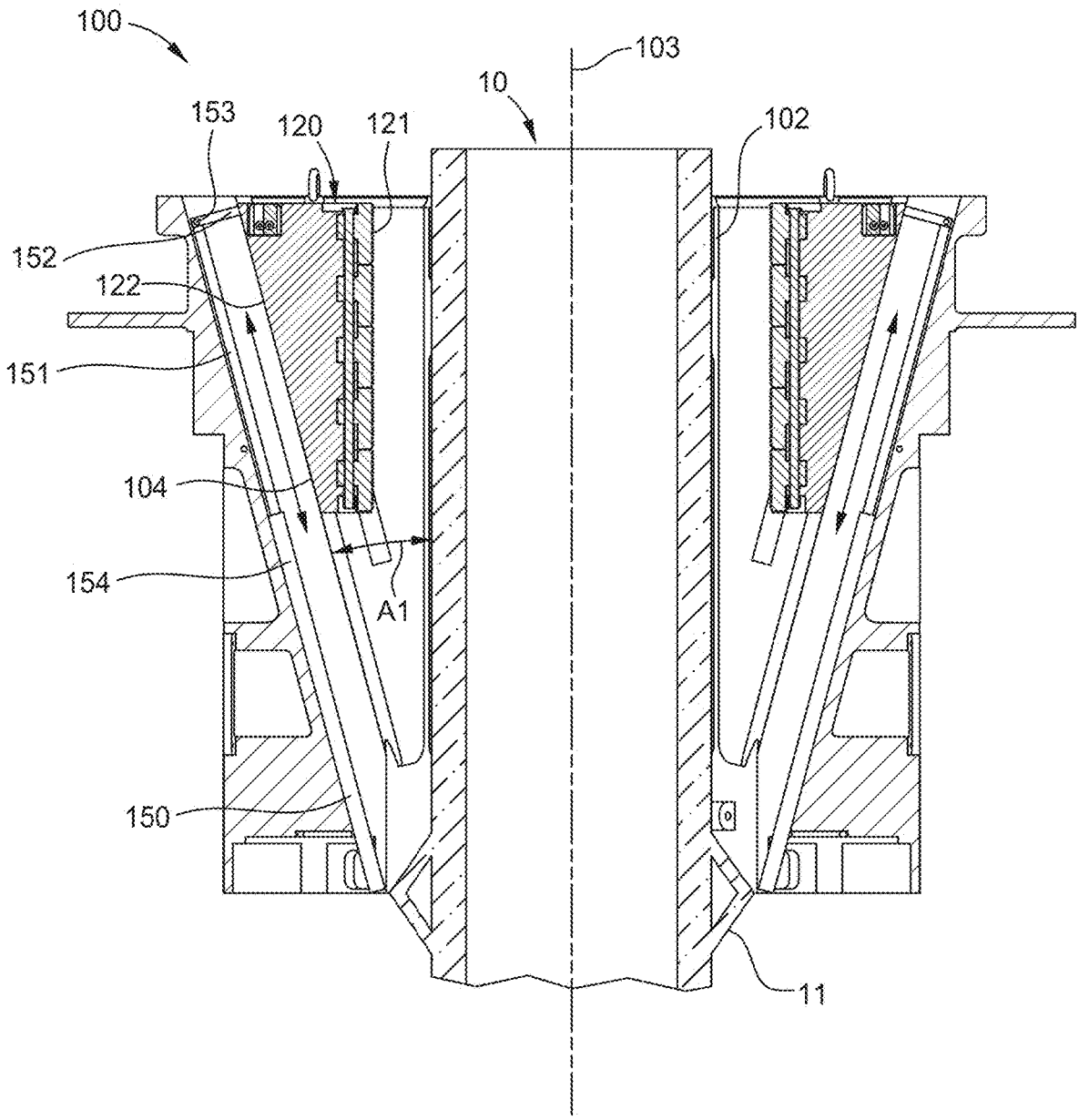
FIG. 2A illustrates a cross-sectional view of the hydraulic spider of FIG. 1 with the slips in a set-back position, according to one or more embodiments.
Figure 2B:
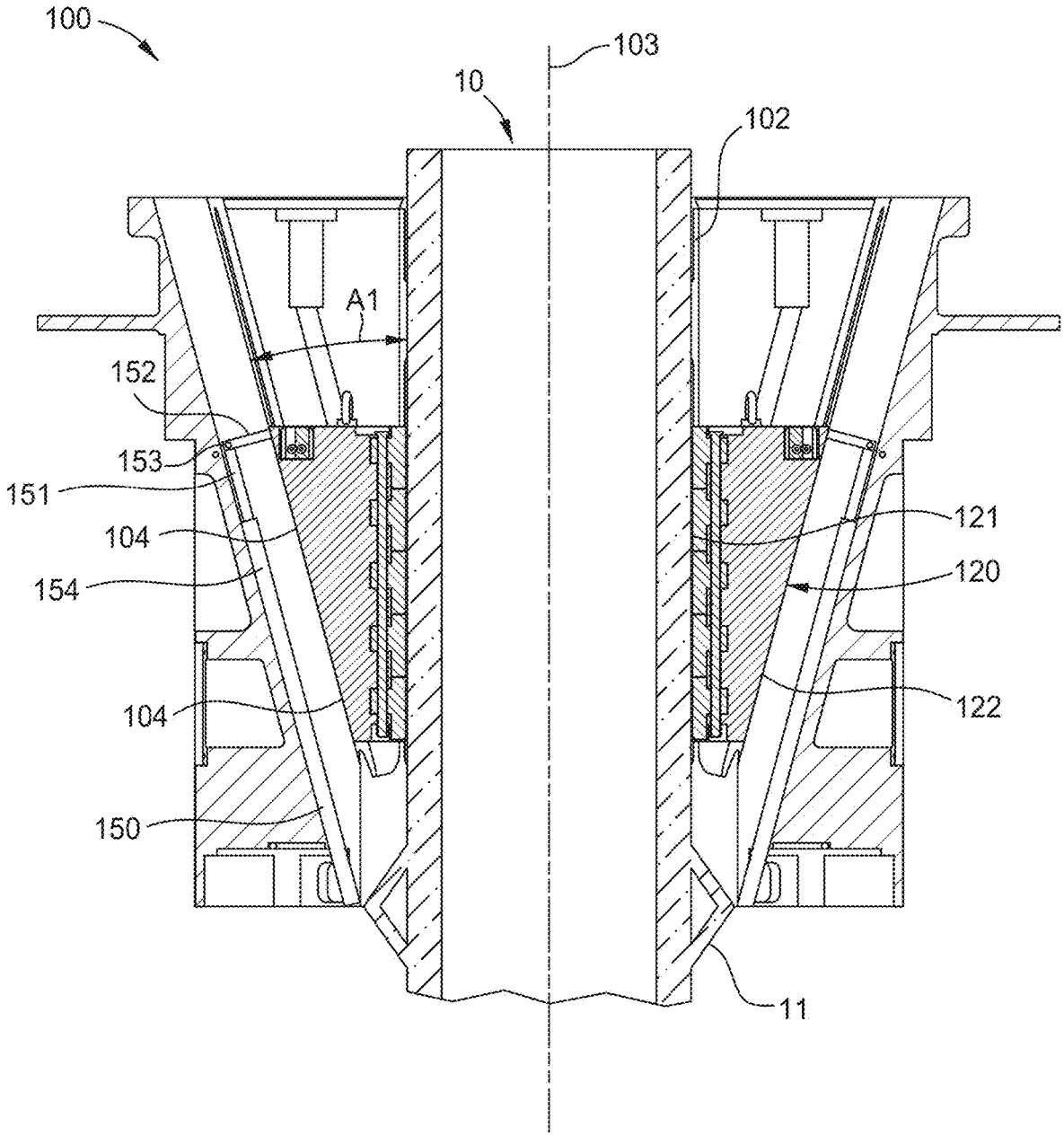
FIG. 2B illustrates a cross-sectional view of the hydraulic spider of FIG. 1 with the slips in an engaged position, according to one or more embodiments.

FIGS. 2A-2B illustrate cross-sectional views of the hydraulic spider 100 with the slips 120 operating between a set-back position, as shown in FIG. 2A, and an engaged position, as shown in FIG. 2B.

According to one mode of operation, a tubular 10 is placed in the bore 102 of the hydraulic spider 100 and the slips 120 extend from a retracted position (e.g., the set-back position), as shown in FIG. 2A, inward towards the central axis 103 of the hydraulic spider 100 to engage with the tubular 10 (e.g., the engaged position), as shown in FIG. 2B. With the tubular 10 engaged and held in place by the slips 120, the tubular 10 may be made-up or broken-out from another tubular. As such, the hydraulic spider 100 is designed to engage and hold the tubular 10 to prevent axial and rotational movement of the tubular 10 while making-up or breaking-out a threaded connection with the tubular 10.

The bore 102 is at least partially defined by the slips 120 and the spider body 101. Although four slips 120 are shown in FIGS. 1-2B, the hydraulic spider 100 may include two, three, four, five, six, seven, eight, or more slips 120. The number of slips 120 may depend on the surface area needed to retain the tubular 10 while the tubular is experiencing a torque or axial load, and while also preventing the tubular 10 from being crushed.

The slips 120 include an inner surface 121 and an outer surface 122. The inner surface 121 is configured to engage with the tubular 10. The outer surfaces 122 of the slips are opposite the inner surface 121 and are slidably engaged with actuation surfaces 104 of the spider body 101 such that the slips 120 can be moved along the actuation surfaces 104 by one or more actuators 150. Each slip 120 may be coupled to a cylinder rod 151 of an actuator 150 by a connection member 152 comprising a pin 153. The cylinder rod 151 may be extended from and retracted into a cylinder 154 of the actuator 150 to raise and lower the slip 120 along the actuation surfaces 104.

The actuation surfaces 104 are tapered at an angle with respect to the central axis 103. For instance, the actuation surfaces 104 may be tapered at an angle A1 of about 11 degrees or more, or about 11 degrees to about 20 degrees from the central axis 103. In one or more embodiments, the actuation surfaces 104 may be about 200 mm to about 500 mm long. In one or more embodiments, the actuators 150 have a stroke of about 200 mm to about 500 mm. The outer surfaces 122 of the slips 120 are similarly angled (e.g., angled complementary to the actuation surfaces 104) such that as the slips 120 slide along the actuation surfaces 104, the inner surfaces 121 of the slips 120 stay about perpendicular to the ground (e.g., the inner surfaces 121 are aligned with, or generally parallel to, the central axis 103 of the hydraulic spider 100). In one or more embodiments, the inner surfaces 121 may stay aligned with the outer surface of the tubular 10 such that, in the engaged position, as shown in FIG. 2B, the inner surfaces 121 engage with the outer surface of the tubular. For example, as the slips 120 are moved up the actuation surfaces 104, the inner surfaces 121 are moved radially outward away from the central axis 103 (moving the slips 120 into the set-back position shown in FIG. 2A) while staying about perpendicular to the ground. And as the slips 120 are moved down the actuation surfaces 104, the inner surfaces 121 are moved radially inward towards the central axis 103 (moving the slips 120 into the engaged position shown in FIG. 2B) while staying about perpendicular to the ground.

The angle A1 of the actuation surfaces 104 and the distance traveled along the actuation surfaces 104 (e.g., the stroke of the actuators 150 or the length of the actuator surfaces 104) determines the position of the inner surfaces 121 in the set-back and engaged positions. The angle and length of the actuation surfaces 104 also determines the radial stroke of each slip 120 (e.g., the radial distance between the inner surface 121 in the engaged position and position of the inner surface 121 in the set-back position). Maximizing the radial stroke of each slip 120 allows for a larger range of diameters of tubulars 10 that may be engaged by the same slips 120 and the same hydraulic spider 100. Further, maximizing the radial stroke of each slip 120 allows for the hydraulic spider 100 to be used with tubulars 10 including external components or features extending past the diameter (e.g., that are located on the diameter) of the tubular 10, such as tubular centralizers 11.

The slips 120 engage with, and disengage from, the outer diameter of the tubular 10. However, tubulars 10 may include external components or features that extend past the outer diameter (e.g., that are located on the outer diameter), such as tubular centralizers 11. Such tubulars 10 with external components or features still need to be lowered or raised through the bore 102 and the slips 120 of the hydraulic spider 100. Therefore, maximizing the radial stroke of the slips 120 allows for tubulars 10 with external components and/or features to be raised and lowered through the bore 102 and the slips 120 of the hydraulic spider 100 without disassembly or interference. For example, the tubular 10 with the tubular centralizers 11 extending to a larger diameter than the diameter of the tubular 10 may be passed through the hydraulic spider 100 without disassembly and/or swapping out the slips 120 due to the maximized radial stroke of each slip 120.

Further, maximizing the radial stroke of the slips 120 allows for a more varied range of diameters of tubulars 10 that may be engaged by the same hydraulic spider 100 and slips 120.

While FIGS. 2A-2B illustrate the slips 120 in the set-back and engaged positions, it is understood that the slips 120 may be in any intermediate position between the set-back and engaged position as necessary for installation of varying diameters of tubulars and components and/or features such as the tubular centralizers 11.

Figure 3:
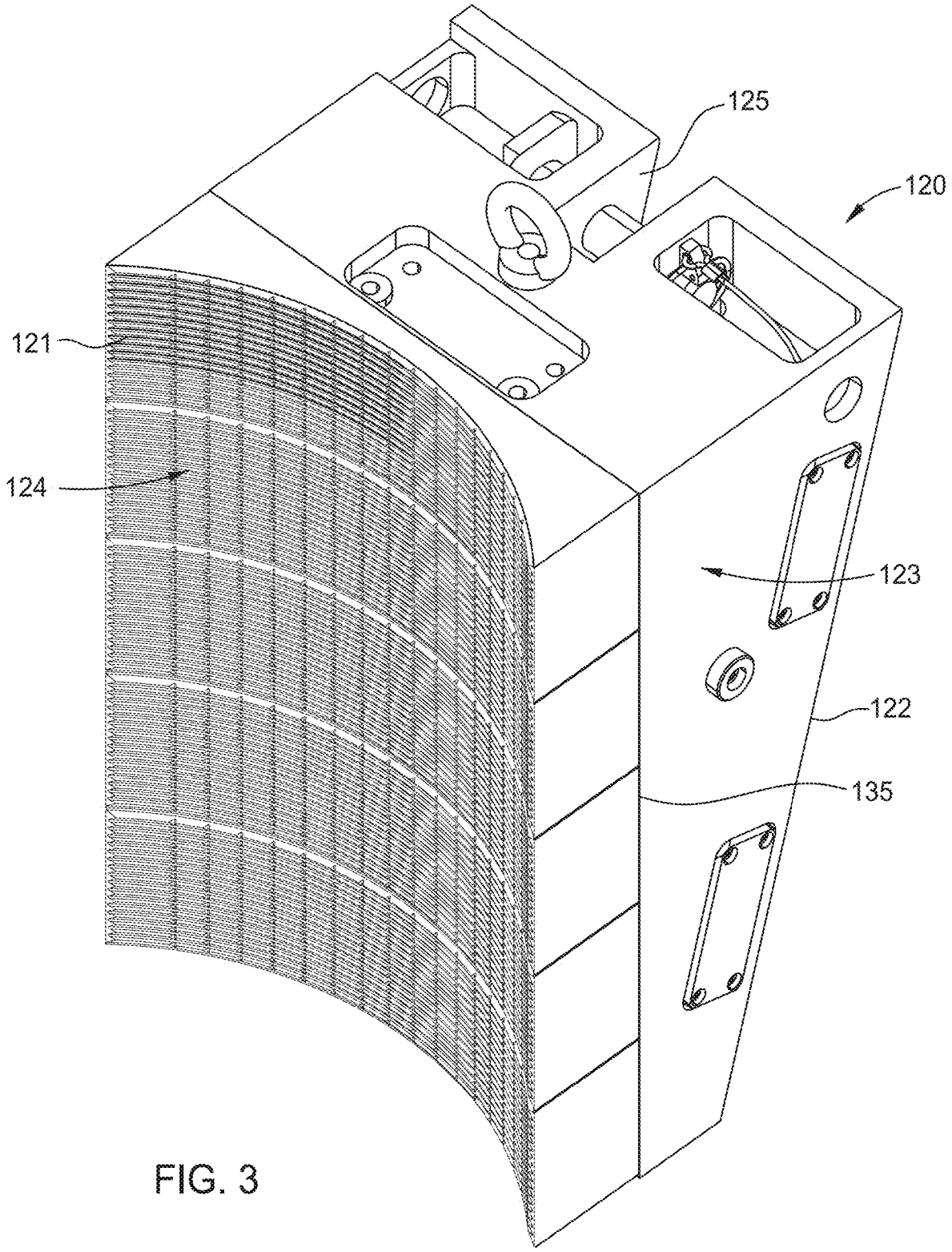
FIG. 3 illustrates an isometric view of a slip of the hydraulic spider of FIG. 1, according to one or more embodiments.

FIG. 3 illustrates an isometric view of one of the slips 120. The slip 120 includes a body 123 and inserts 124 removably coupled to an inner surface 135 of the body 123.

The body 123 may be wedge-shaped and includes the outer surface 122 of the slip 120. The inserts 124 are coupled to the inner surface 135 of the body 123 and form the inner surface 121 of the slip 120. In one or more embodiments, the inserts 124 may be at least partially disposed in and removably coupled to the inner surface 135 of the body 123. In one or more embodiments, the inserts 124 may be coupled to the inner surface 135 of the body 123 by fasteners. The inserts 124 are coupled to the inner surface 135 of the body 123 in a stacked arrangement (e.g., positioned above and/or below adjacent inserts 124). Each insert 124 extends across the width of the body 123.

There may be one or more inserts 124 per slip 120. In one or more embodiments, there may be five inserts 124 per slip 120, as illustrated. In one or more embodiments, there may be one, two, three, four, five, six, seven, eight, or more inserts 124 per slip 120.

The wedge-shape of the body 123 allows for the outer surface 122 to include a complementary angle to the actuation surface 104 of the hydraulic spider 100 so that the slips 120 may move along the actuation surface 104 to move the inner surface 121 of the slips 120 radially inward and outward while keeping the inner surface 121 parallel to the central axis of 103 of the hydraulic spider 100, as described above with respect to FIGS. 2A and 2B.

The body 123 may include a recess 125 in the outer surface 122 of the slip 120. The recess 125 is shaped to receive and engage with the actuator 150 that moves (e.g., raises and lowers) the slip 120.

Figure 4A:
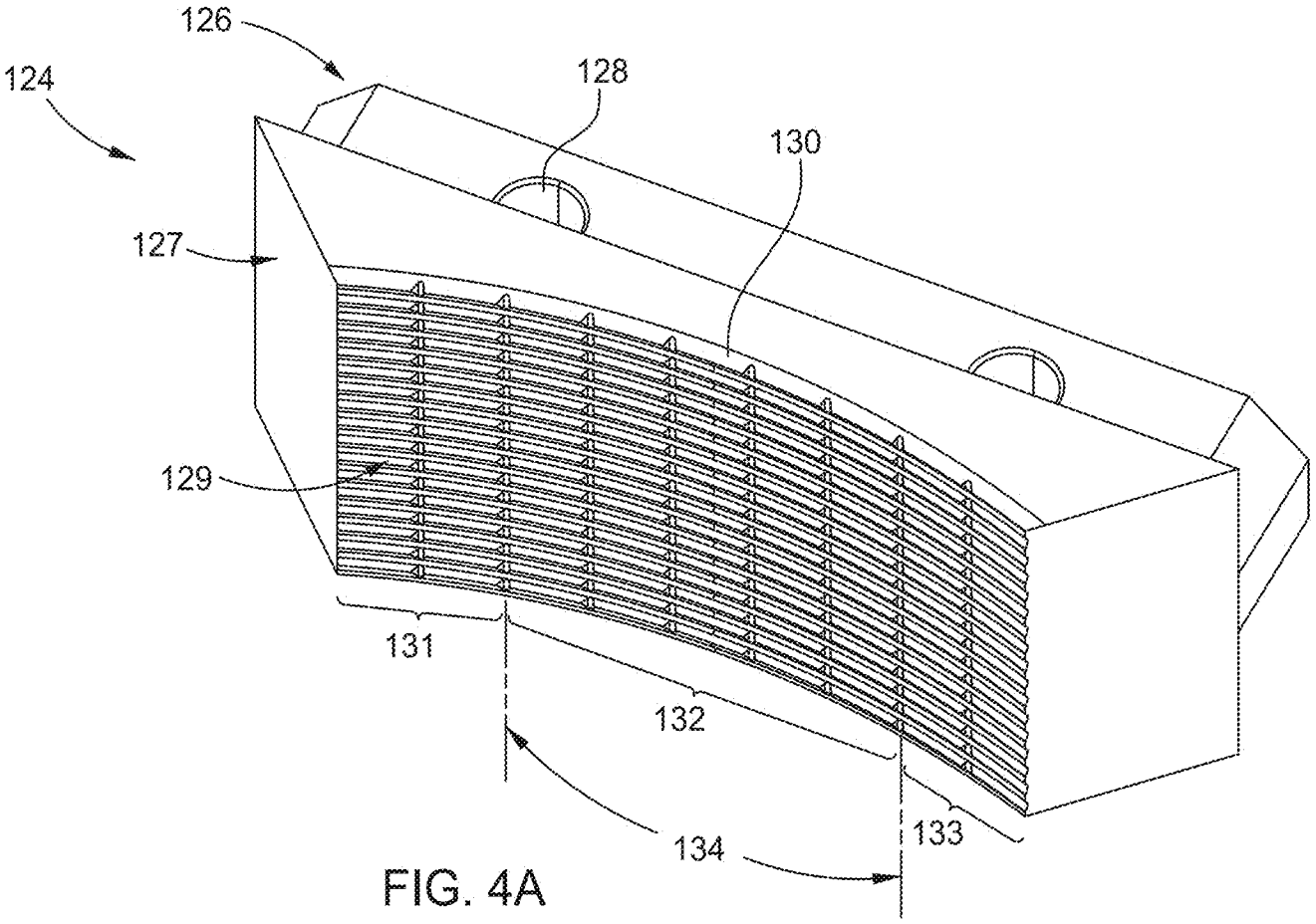
FIG. 4A illustrates an isometric view of a slip insert of the slip of FIG. 3, according to one or more embodiments.
Figure 4B:
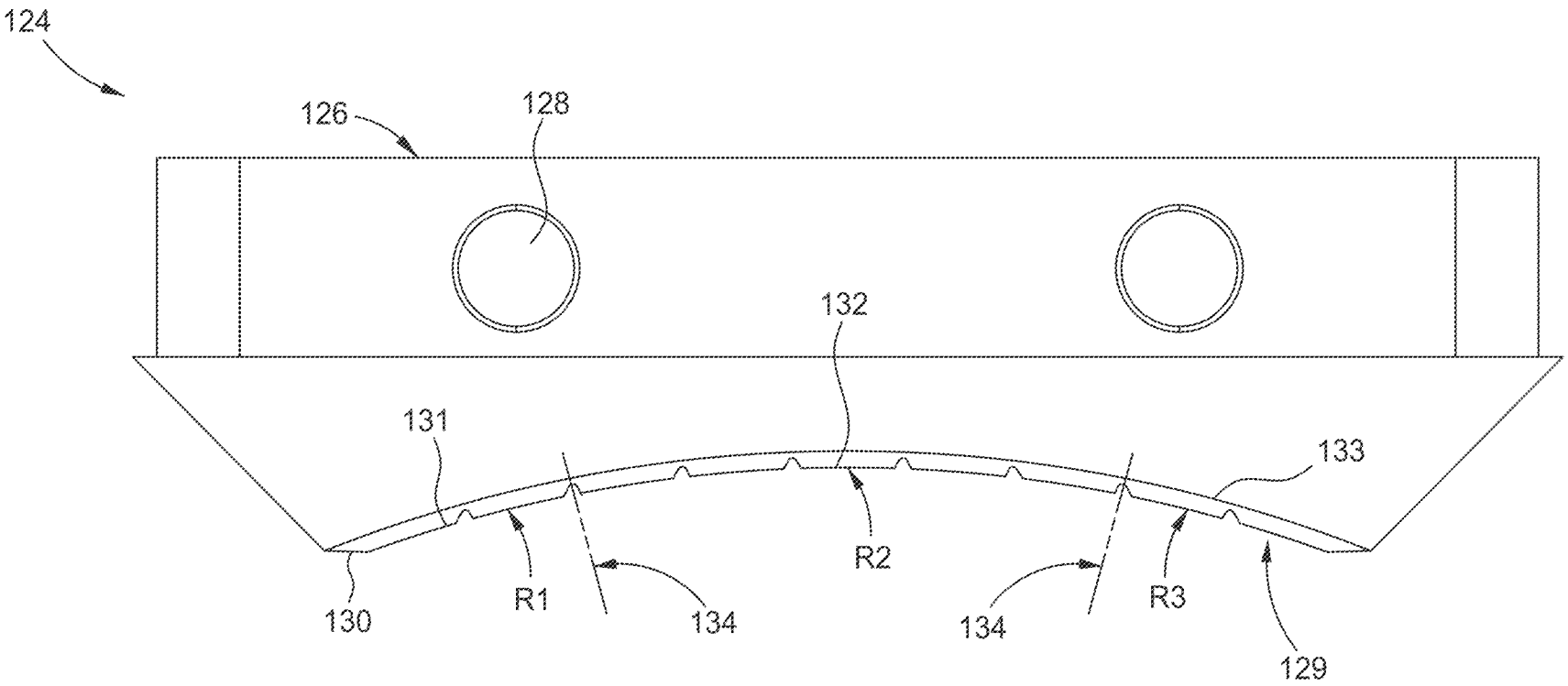
FIG. 4B illustrates a top view of the slip insert of FIG. 4, according to one or more embodiments.

FIGS. 4A-4B illustrate one of the inserts 124 of the slip 120. FIG. 4A illustrates an isometric view of the insert 124 of the slip 120. FIG. 4B illustrates a top view of the insert 124.

Each insert 124 includes an installation body 126 and an engagement body 127. The installation body 126 is disposed on the side of the insert 124 that is coupled to the body 123 of the slip 120. The installation body 126 may be a protrusion extending from the engagement body 127 that may be at least partially disposed into one or more recesses in the body 123 of the slip 120. In one or more embodiments, the installation body 126 includes one or more holes 128. The one or more holes 128 may be used to couple the insert 124 to the body 123. For example, one or more fasteners may be disposed through the body 123 and through the one or more holes 128 to couple the insert 124 to the body 123. The engagement body 127 may have tapered sides as illustrated in FIGS. 4A-4B, or may have straight sides as illustrated in FIG. 3.

The engagement body 127 protrudes from the body 123 of the slip 120 and includes an engagement surface 129. The engagement surface 129 is concave. The engagement surface 129 of the inserts 124 form the inner surface 121 of the slip 120. The engagement surface 129 engages with the outer diameter of the tubular 10. The concavity of the engagement surface 129 at least partially defines the bore 102 of the hydraulic spider 100. The combination of the engagement surfaces 129 of each insert 124 in each slip 120 defines a portion of a partial circle shaped to engage the tubular 10 when the slips 120 are in the engaged position.

The engagement surface 129 includes teeth 130. In one or more embodiments, the teeth 130 are integrally formed in the engagement body 127 of the insert 124. In one or more embodiments, the teeth 130 are cut into the engagement surface 129. In one or more embodiments, the teeth 130 may be may be generally shaped as triangular prisms. In one or more embodiments, the triangular prisms may be longer in length than they are tall in height (e.g., the triangular prisms may be shorter in the direction parallel to the tubular 10 and/or the central axis 103 of the hydraulic spider 100). In one or more embodiments, the cutting edge of the teeth (e.g., the top edge of the triangular prisms) may be oriented horizontally such that they run perpendicular to the central axis 103 of the hydraulic spider 100.

The engagement surface 129 includes concave surface portions comprising the teeth 130. In the illustrated embodiment, the engagement surface 129 includes a first surface portion 131, a second surface portion 132, and a third surface portion 133. Although the illustrated embodiment includes three surface portions, it is to be understood that there may be any number of surface portions (such as two, three, four, five, or six or more) and the foregoing description of each portion is applicable to each portion. In one or more embodiments, the surface area of any of the concave surface portions (e.g., first surface portion 131, second surface portion 132, third surface portion 133) may be about 1% to about 99% of the surface area of the engagement surface 129 so long as the total surface area of the surface portions adds up to the total surface area of the engagement surface 129. The first surface portion 131 makes up one end of the engagement surface 129 and spans the height of the engagement surface 129, the third surface portion 133 makes up another end of the engagement surface 129 and spans the height of the engagement surface 129, and the second surface portion 132 is disposed between the first surface portion 131 and the third surface portion 133 and spans the height of the engagement surface 129.

The first surface portion 131 has a first radius of curvature R1, the second surface portion 132 has a second radius of curvature R2, and the third surface portion 133 has a third radius of curvature R3. In one or more embodiments, any of R1, R2, and R3 may be equal to, or different to, one another. In one or more embodiments, R1 is greater than, less than, or equal to R2. In one or more embodiments, R1 is greater than, less than, or equal to R3. In one or more embodiments, R2 is greater than, less than, or equal to R1. In one or more embodiments, R2 is greater than, less than, or equal to R3. In one or more embodiments, R3 is greater than, less than, or equal to R1. In one or more embodiments, R3 is greater than, less than, or equal to R2. In the illustrated example, R1 is equal to R3 and R1 and R3 are greater than R1.

As an example, R1 may be about 3.0 inches to about 25.0 inches, R2 may be about 3.0 inches to about 25.0 inches, and R3 may be about 3.0 inches to about 25.0 inches.

The surface portions 131, 132, 133 and varying radii R1, R2, R3 are illustrated as being separated by imaginary lines 134 for illustrative purposes. In one or more embodiments, there may exist an edge where imaginary lines 134 are located due to the differences in radii between adjacent surface portions 131, 132, 133.

Each surface portion 131, 132, 133 includes a radius that corresponds to a tubular diameter (e.g., the outer radius of the tubular matches and/or corresponds to one or more radii of the surface portions 131, 132, 133). Thus, the inserts 124 are able to be used with multiple tubulars of different diameters. For instance, one insert 124 may be used with a first tubular with a first diameter and the same insert 124 may be used with a second tubular with a second, different diameter. Because the radius of at least one of the one or more surface portions 131, 132, 133 matches and/or corresponds to the outer radius of the tubulars, each of the tubulars are able to be fully or mostly engaged by the one or more surface portions 131, 132, 133 with the matching and/or corresponding radius. As an example, the first surface portion 131 and the third surface portion 133 of all the inserts 124 for each of the slips 120 may have the same radius (i.e., R1 is the same as R3), while the second surface portion 132 has a different radius (i.e., R2 is different than R1 and R3. In this example, the slips 120 can be used to engage at least two different sizes of tubulars. A first size tubular having an outer diameter that corresponds to R1 and R3 will be engaged by the first and third surface portions 131, 133 of the inserts 124, while a second size tubular having an outer diameter that corresponds to R2 will be engaged by the second surface portions 132 of the inserts 124.

According to one mode of operation, the hydraulic spider 100 may be configured to engage with a first tubular (such as tubular 10 of FIGS. 2A-2B) which may have an outer diameter of 10.0 inches (and an outer radius of 5.0 inches) and a second tubular which may have an outer diameter of 11.0 inches (and an outer radius of 5.5 inches). For such operation, R1 may be 5.5 inches, R2 may be about 5.0 inches, and R3 may be about 5.5 inches. In the operation, the first surface portion 131 and third surface portion 133 engage with the 11.0 inch diameter tubular and the second surface portion 132 engages with the 10.0 inch diameter tubular.

Figure 5:
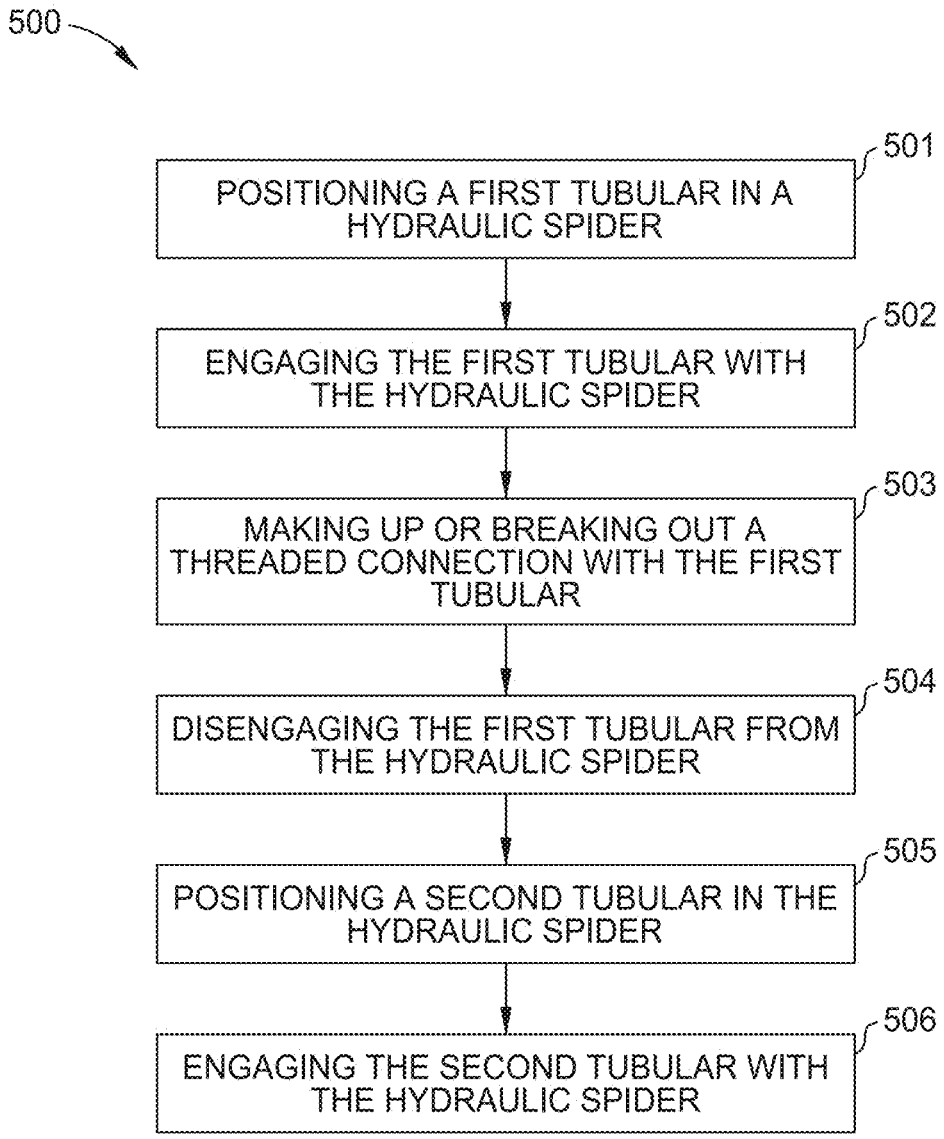
FIG. 5 illustrates a method for engaging tubulars with a hydraulic spider, according to one or more embodiments.

FIG. 5 illustrates a method 500 for engaging tubulars (such as tubular 10 of FIGS. 2A-2B) with a hydraulic spider (such as hydraulic spider 100 of FIGS. 1-2B), according to one or more embodiments.

At step 501, a first tubular (of a tubular string) is positioned in a bore (such as bore 102 of FIGS. 1-2B) of the hydraulic spider, which is in a set-back position (such as the set-back position shown in FIG. 2A) or an intermediate position between the set-back position and an engaged position (as shown in FIG. 2B). The first tubular may be positioned in the bore of the hydraulic spider by an elevator. The first tubular has a first diameter. In one or more embodiments, the first tubular may include external features or components extending outside of the first diameter, such as centralizer 11 of FIGS. 2A-2B. In one or more embodiments, the first tubular is lowered into the bore of the hydraulic spider or raised into the bore of the hydraulic spider such that the external features or components pass through the bore of the hydraulic spider and the first tubular is moved into a position for engagement by the hydraulic spider.

At step 502, the first tubular is engaged by one or more slips (such as slips 120 of FIGS. 1-3) of the hydraulic spider. The first tubular is engaged by moving the one or more slips to the engaged position. Moving the one or more slips to the engaged position may include moving an angled outer surface of the slips (such as outer surface 122 of FIGS. 2A-3) along angled actuation surfaces (such as actuation surface 104 of FIGS. 2A-2B) of the hydraulic spider. In one or more embodiments, the actuation surfaces may be angled about 11 degrees to about 20 degrees from a central axis (such as central axis 103 of FIGS. 1-2B) of the hydraulic spider. In one or more embodiments, moving the slips along the actuation surfaces includes moving the slips with one or more actuators (such as actuators 150 of FIGS. 2A-2B) coupled to the slips and the hydraulic spider.

In the engaged position, inserts (such as inserts 124 of FIGS. 3-4) disposed in the slips engage with the outer diameter of the first tubular. The inserts include a plurality of surface portions (such as surface portions 131, 132, 133). One or more of the plurality of surface portions engage with the outer diameter of the first tubular. The one or more surface portions may include a first radius corresponding to the diameter of the first tubular.

At step 503, while the first tubular is engaged by the hydraulic spider, another tubular or tubular string is made up to or broken out from a threaded connection with the first tubular.

At step 504, the first tubular is disengaged by the hydraulic spider after being re-engaged by the elevator. In one or more embodiments, the slips are moved from the engaged position to the set-back position (or an intermediate position). Moving the one or more slips from the engaged to the set-back position or intermediate position may include moving the angled outer surface of the slips along the angled actuation surfaces of the hydraulic spider. In one or more embodiments, moving the slips along the actuation surfaces includes moving the slips with the one or more actuators coupled to the slips and the hydraulic spider. The first tubular may then be removed from the hydraulic spider by the elevator.

At step 505, a second tubular may be positioned in the hydraulic spider. The second tubular includes a second outer diameter which may be larger or smaller than the first diameter of the first tubular. In one or more embodiments, the second tubular may include external features or components extending outside of the second diameter, such as a centralizer. In one or more embodiments, the second tubular is lowered into the bore of the hydraulic spider or raised into the bore of the hydraulic spider by the elevator such that the external features or components pass through the bore of the hydraulic spider. In one or more embodiments, the second tubular may be a part of a tubular string that the first tubular was previously connected to before it was broken out from the tubular string.

At step 506, the second tubular is engaged by the same one or more slips of the hydraulic spider. The second tubular is engaged by moving the one or more slips to the engaged position. Moving the one or more slips to the engaged position may include moving the angled outer surface of the slips along the angled actuation surfaces of the hydraulic spider. In one or more embodiments, moving the slips along the actuation surfaces includes moving the slips with the one or more actuators coupled to the slips and the hydraulic spider.

In the engaged position, the inserts engage with the outer diameter of the second tubular. One or more of the plurality of surface portions engage with the outer diameter of the second tubular. The one or more surface portions of the inserts that engage with the outer diameter of the second tubular are different than the one or more surface portions of the inserts that engage with the first tubular. The one or more surface portions may include a second radius corresponding to the diameter of the second tubular.

Any one or more components of the hydraulic spider 100 may be integrally formed together, directly coupled together, and/or indirectly coupled together and are not limited to the specific arrangement of components illustrated in FIGS. 1-4.

Any one or more of the components, embodiments, or steps of the hydraulic spider 100 and method 500, may be combined in whole or part with any other components, embodiments, or steps of the hydraulic spider 100 and method 500.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. An insert for a slip in a hydraulic spider, comprising:
an engagement body including an engagement surface, the engagement surface including:
a first concave surface portion comprising teeth, the first concave surface portion having a first radius of curvature;
a second concave surface portion comprising teeth, the second concave surface portion having a second radius of curvature that is different than the first radius of curvature; and
a third concave surface portion comprising teeth, the third concave surface portion having a third radius of curvature, wherein the second concave surface portion is disposed between the first concave surface portion and the third concave surface portion, and wherein the first radius of curvature and the third radius of curvature are equal.

2. The insert of claim 1, wherein the first radius of curvature is larger than the second radius of curvature.

3. The insert of claim 1, wherein the first radius of curvature and the third radius of curvature are greater than the second radius of curvature.

4. The insert of claim 1, wherein the first radius of curvature and the third radius of curvature are 3.0 inches to 25.0 inches.

5. The insert of claim 1, wherein the second concave surface portion is 25% to 75% of the engagement surface.

6. The insert of claim 1, wherein the first radius of curvature is 3.0 inches to 25.0 inches.

7. The insert of claim 1, wherein the second radius of curvature is 3.0 inches to 25.0 inches.

8. A slip for use in a hydraulic spider, comprising:
a slip body; and
one or more inserts coupled to an inner surface of the slip body, wherein each of the one or more inserts comprise:
an engagement body including an engagement surface, the engagement surface including:
a first concave surface portion comprising teeth, the first concave surface portion having a first radius of curvature; and
a second concave surface portion comprising teeth, the second concave surface portion having a second radius of curvature; and
a third concave surface portion comprising teeth, the third concave surface portion having a third radius of curvature, wherein the second concave surface portion is disposed between the first concave surface portion and the third concave surface portion, wherein the second radius of curvature is different than the first radius of curvature and the third radius of curvature, and wherein the first radius of curvature and the third radius of curvature are equal.

9. The slip of claim 8, wherein the first radius of curvature and the third radius of curvature are greater than the second radius of curvature.

10. The slip of claim 8, wherein the first radius of curvature and the third radius of curvature are 3.0 inches to 25.0 inches.

11. The slip of claim 8, wherein the second radius of curvature is 3.0 inches to 25.0 inches.

12. The slip of claim 8, wherein the second concave surface portion is 25% to 75% of the engagement surface.

13. The slip of claim 8, wherein the slip body includes an outer surface opposite the inner surface, and wherein the outer surface is tapered at an angle of at least 11 degrees from the inner surface.

14. A hydraulic spider, comprising:
a hydraulic spider body including a bore and one or more actuation surfaces, wherein the one or more actuation surfaces includes a taper angle of at least 11 degrees;
one or more slips engaged with the one or more actuation surfaces such that movement along the one or more actuation surfaces causes the one or more slips to move radially inward towards a center of the bore or radially outward away from the center of the bore, the one or more slips including one or more inserts defining an inner surface of each slip, the one or more inserts including:
an engagement body including an engagement surface, the engagement surface including:
a first concave surface portion comprising teeth, the first concave surface portion having a first radius of curvature; and
a second concave surface portion comprising teeth, the second concave surface portion having a second radius of curvature; and
a third concave surface portion comprising teeth, the third concave surface portion having a third radius of curvature, wherein the second concave surface portion is disposed between the first concave surface portion and the third concave surface portion, and wherein the first radius of curvature and the third radius of curvature are equal; and
one or more actuators coupled to the one or more slips, wherein the one or more actuators move the one or more slips along the one or more actuation surfaces.

15. The hydraulic spider of claim 14, wherein the first radius of curvature and the third radius of curvature are greater than the second radius of curvature.

16. The hydraulic spider of claim 14, wherein the one or more slips include an outer surface opposite the inner surface, and wherein the outer surface is tapered at an angle of complementary to the angle of the one or more actuation surfaces.

* * * * *